US006123242A

United States Patent [19]

Kersten

[11] Patent Number: 6,123,242

[45] Date of Patent: Sep. 26, 2000

[54] EXPLOSIVE POWDER CHARGE OPERATED BOLT-SETTING TOOL

[75] Inventor: Olaf Kersten, Krefeld, Germany

[73] Assignee: Berner GmbH, Germany

[21] Appl. No.: 09/094,138

[22] Filed: Jun. 9, 1998

[51] Int. Cl.[7] ..... B25C 1/14

[52] U.S. Cl. ..... 227/10; 173/212

[58] Field of Search ..... 227/9, 10, 11, 227/130; 173/210, 212

[56] References Cited

U.S. PATENT DOCUMENTS

| | | | |
|---|---|---|---|
| 2,877,750 | 3/1959 | Maier . | |
| 3,255,942 | 6/1966 | Bell et al. . | |
| 3,589,584 | 6/1971 | Ohlsson et al. | 227/10 |
| 3,744,240 | 7/1973 | Henning et al. . | |
| 3,804,314 | 4/1974 | Gilbert | 227/10 |
| 3,815,475 | 6/1974 | Howard et al. . | |
| 4,358,041 | 11/1982 | Ollivier | 227/10 |
| 4,711,385 | 12/1987 | Jochum . | |
| 4,711,851 | 12/1987 | McNamara et al. . | |
| 4,753,151 | 6/1988 | Peterson . | |
| 4,824,003 | 4/1989 | Almeras et al. | 227/10 |
| 4,941,391 | 7/1990 | Ehmig et al. . | |
| 5,170,922 | 12/1992 | Ehmig et al. | 227/10 |
| 5,332,140 | 7/1994 | Almeras et al. | 227/9 |
| 5,538,172 | 7/1996 | Jochum et al. . | |
| 5,676,434 | 10/1997 | Ichikawa et al. . | |
| 5,797,534 | 8/1998 | Almeras et al. . | |

FOREIGN PATENT DOCUMENTS

| | | |
|---|---|---|
| 4313504 | 10/1994 | Denmark . |
| 0223740 | 11/1986 | European Pat. Off. . |
| 0274957 | 12/1987 | European Pat. Off. . |
| 0638395 | 4/1994 | European Pat. Off. . |
| 0780195 | 10/1996 | European Pat. Off. . |
| 0798084 | 10/1997 | European Pat. Off. . |

*Primary Examiner*—Scott A. Smith
*Attorney, Agent, or Firm*—Douglas J. Christensen

[57] ABSTRACT

The invention relates to a pyrotechnically operated bolt-setting tool having a barrel (11, 12) which is guided in a barrel-guiding sleeve (1) and can be brought into operative engagement with a locking part (18), the barrel-guiding bore (26) of which accommodates a piston (21), which has a piston shank (23) and a piston head (22), and which has a cartridge store (16) on that side which is remote from the mouth, in which bolt-setting tool the barrel (11, 12), on its side which faces the cartridge store (16), has ventilation slots (31) which are released by the piston head (22) as the bolt is being fired, before the piston (21) reaches its end position on the mouth side, in which position an air cushion is compressed between the piston head (22) and the barrel (11, 12), which air cushion subsequently presses the piston (21) back into its starting position.

16 Claims, 1 Drawing Sheet

EXPLOSIVE POWDER CHARGE OPERATED BOLT-SETTING TOOL

BACKGROUND OF THE INVENTION

The present invention relates to an explosive powder charge operated setting tool suitable for setting bolts.

Non-repeating setting tools operated by an explosive power charge are known for instance from the published European Patent Application No. 0,233,740, in which the combustion gases, which are produced after firing the cartridge containing the explosive power charge, are used to guide the piston back into the starting position. In order to conduct the combustion gases into the space between the piston head and barrel, so that they form here a combustion-gas cushion which presses the piston back into its starting position after the bolt has been fired, complicated gas bypasses having valves and seals have been provided. The ability of said valves to function is moreover adversely affected by combustion residues which are entrained by the combustion gases. In this case, because of the seal-tightness required, a series of parts have to be manufactured with great accuracy.

The setting tool known from the published European Patent Application No. 0,638,395 also uses the combustion gases to guide back the piston into its starting position. The combustion gases are guided via a valve device into a storage space wherein the combustion gases are compressed. To control this, the barrel consists of two parts which are relatively close to each other in the direction of their axis. This solution also provides the drawbacks that on one hand the combustion gases are used to guide the piston back into its starting position so that combustion residues may cause problems, and that on the other hand this requires a relatively complicated construction which is not completely shown in the drawings of this application.

Additionally, the published European Patent Application No. 0,798,084 describes a setting tool using combustion gases and a slot valve system for guiding back the piston into its starting position.

Further, U.S. Pat. No. 2,877,750 deals with a buffer mechanism for a setting tool to prevent the piston from overworking. The buffering of the piston is achieved by conducting combustion gases into a buffer zone in moving direction of the piston before the latter so that the combustion gases are compressed to effect the deceleration of the piston.

SUMMARY OF THE INVENTION

The invention relates to a pyrotechnically operated bolt-setting tool having a barrel which is guided in a barrel-guiding sleeve and can be brought into operative engagement with a locking part, the barrel-guiding bore of which accommodates a piston, which has a piston shank and a piston head, and which has a cartridge store on that side which is remote from the mouth, in which bolt-setting tool the barrel on its side which faces the cartridge store, has ventilation slots which are released by the piston head as the bolt is being fired, before the piston reaches its end position on the mouth side, in which position an air cushion is compressed between the piston head and the barrel, which air cushion subsequently presses the piston back into its starting position.

It is an object of the invention to provide a setting tool of a simplified construction.

It is a further object of the invention to provide a setting tool using no combustion gases for guiding back its position into its starting position.

In accordance with the invention, the piston is reset using an air cushion which forms between the piston head and the barrel at that end of the barrel-guiding bore for the piston head which is on the mouth side of the barrel. This air cushion not only intercepts the piston, but also acts as an air spring since the pressure behind the piston drops, due to the release of corresponding ventilation slots in the barrel, before the pressure in the air cushion.

These and other objects and features of the present invention will be understood upon consideration of the following detailed description of the invention and the accompanying drawings.

DETAILED SPECIFICATION

Figures 1, 2, 3:
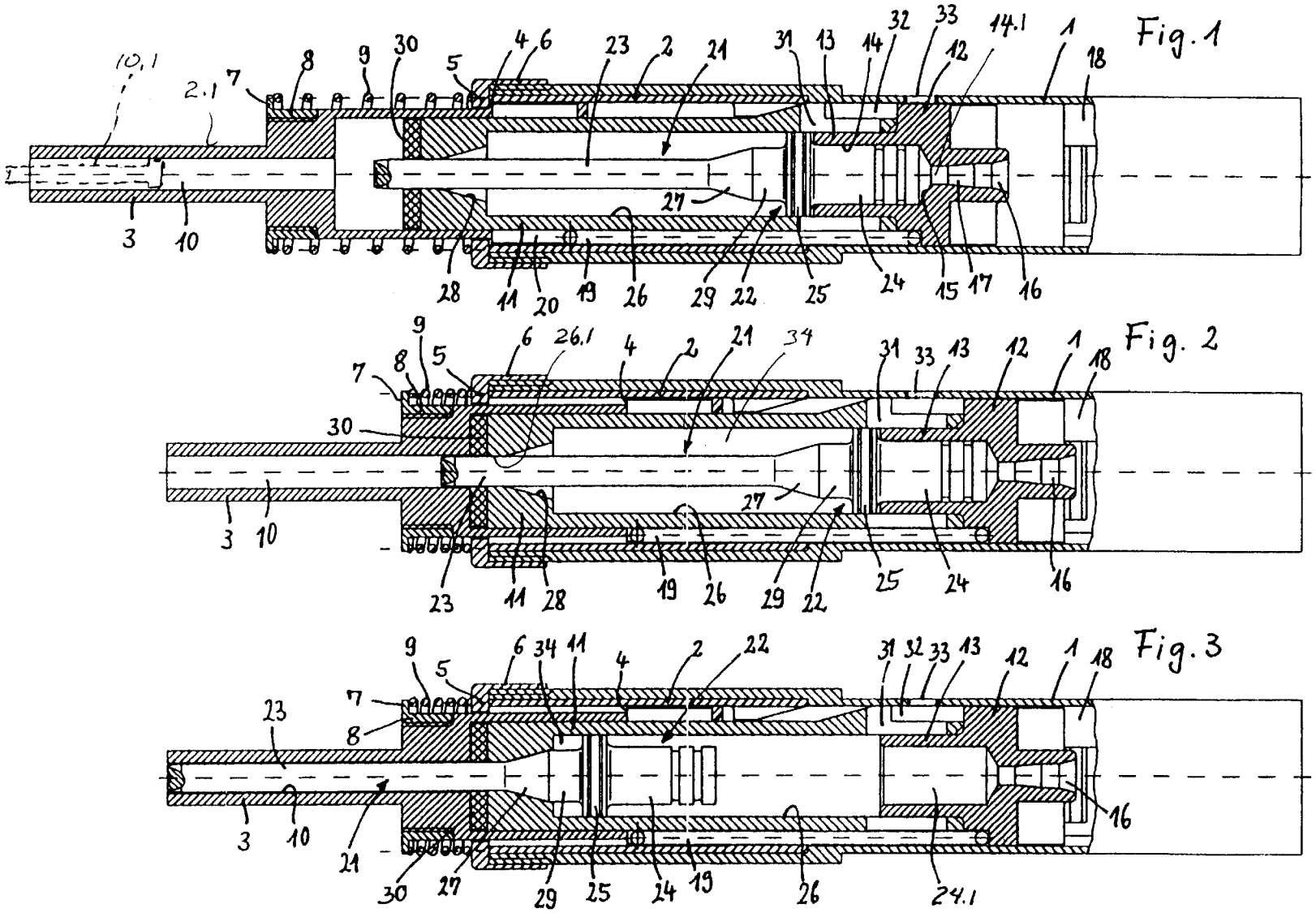
FIG. 1 shows a sectional detail of the barrel-side part of a bolt-setting tool in its starting position.
FIGS. 2 and 3 show the detail of the setting tool before the bolt-setting procedure and at the end of the bolt-setting procedure, respectively.

The explosive powder charge operated bolt-setting tool shown comprises a barrel-guiding sleeve 1 which accommodates an insert 2, in the form of a sleeve, on the mouth side 2.1 in a fixed manner. The insert 2 accommodates a bolt guide 3 which can be displaced therein and is provided with a shoulder 4 which bears, in the starting position of FIG. 1, against an inwardly directed flange section 5 of a threaded piece 6 screwed on the mouth side onto the barrel-guiding sleeve 1. A helical spring 9 is clamped between the flange section 5 and an outwardly directed flange section 7 of a threaded piece 8 screwed onto the bolt guide 3, which helical spring pretensions the bolt guide 3 into the starting position of FIG. 1.

The bolt guide 3 has a bore 10 for receiving a bolt 10.1 to be fired, which bore is widened on that side which is remote from the mouth in order displaceably to receive that end of a barrel-front part 11 which is on the mouth side, while the insert 2 serves as a safety stop for the barrel-front part 11, should the tool be operated without a bolt being loaded.

Furthermore, a barrel-rear part 12 is provided, this being inserted by an extension 13 into the barrel-front part 11 and there being formed therein a piston retainer 14 and a combustion space adjacent to a conical barrel base 15. The barrel-rear part 12 is furthermore provided with a cartridge store 16 for receiving a cartridge, the cartridge store 16 being adjoined by a tapering bore 17 which leads into the barrel base 15. A locking part 18 having a cartridge-strip guide is located adjacent to the cartridge store 16.

The barrel-rear part 12 is connected to the bolt guide 3 via one or more connecting rods 19 in such a manner that the distance between the two can vary within predetermined limits which are determined by an axial groove 20, in which that end of the connecting rod 19 which is on the mouth side can be displaced. The connecting rod 19 expediently has hook-shaped ends with which it is fitted into the axial groove 20 or into a corresponding recess on the barrel-rear part 12.

A piston 21 having a piston head 22 and a piston shank 23 is furthermore provided. The piston shank 23 can be displaced as far as the mouth side of the bore 10 of the bolt guide 3 (FIG. 3). The piston head 22 has a first section 24 which is accommodated in a first piston chamber 24.1 in the starting position by the piston retainer 14 of the barrel-rear part 12, and a second section 25 having an enlarged diameter, which is guided by the barrel-guiding bore 26 engaging the piston of the barrel-front part 11 and the piston shank receiving bore 26.1. Between the piston shank 23 and section 25, the piston 21 has a transition piece with a conical end 27 on the mouth side which is assigned a conical retainer 28 at the end of the barrel-front part 11 which is on the mouth side, and a cylindrical section 29 which adjoins said end 27 and is adjacent to the section 25.

A damping washer 30 can be arranged at that end of the barrel-front part 11 which is on the mouth side, from which the piston shank 23 protrudes.

At its end which is in engagement with the barrel-rear part 12, the barrel-front part 11 is provided with a plurality of ventilation slots 31 which are distributed over its circumference and are virtually concealed by the section 25 of the piston 21 in the starting position of FIG. 1. The ventilation slots 31 lead into an annular space which is formed by a turned portion 32 at the end of the barrel-front part 11 and is surrounded by the barrel-guiding sleeve 1. The barrel-guiding sleeve 1 is provided with corresponding ventilation openings 33, so that the ventilation slots 31 are connected to the outside.

In order to fire a bolt, the bolt guide 3 receives a corresponding bolt 10.1. The bolt-setting tool is placed onto a wall or the like, into which the bolt is to be fired, and is brought into the shooting position by pressing against the wall (FIG. 2). By this means, the bolt guide 3 is pressed, counter to the force of the helical spring 9, into the barrel-guiding sleeve 1 until the helical spring 9 is pressed together, with the result that the barrel-front part 11 and barrel-rear part 12 are moved backwards, thereby enabling the cartridge store 16 to receive a cartridge and to be brought into a launching position with respect to the locking part 18.

By firing the cartridge, the resultant combustion gases cause the piston 21 in the barrel 11, 12 to move forward towards the mouth side, the air between the section 24 of the piston head 22 and the mouth side of the barrel-front part 11 simultaneously being compressed until the conical end 27 reaches its retainer 28 in the barrel-front part 11 (FIG. 3). The bolt is then fired and the air in a second chamber configured as an annular space 34 is compressed.

Before this stage is reached, the ventilation slots 31 have already been released to allow the combustion gases to escape, with the result that the rear side of the piston is connected to the outside, the pressure behind the piston 21 thereby correspondingly dropping. This release takes place whenever the section 24 of the piston head 22 has emerged from the barrel-rear part 12 and the piston 21 is correspondingly accelerated.

The volume of air compressed in the annular space 34 is built up at the outlet side of the barrel-front part 11, owing to the annular space 34 being sealed with respect to the barrel-guiding bore 26 by the section 25 of the piston 21 and by the piston shank 23 and the adjoining, conical section 27, and intercepts the piston 21.

The volume of air compressed in the annular space 34 expands again owing to the drop in pressure on the rear side of the piston and thereby guides the piston 21 back into its starting position in which the section 25 of the piston head 22 is accommodated by the barrel-rear part 12 and the section 24 of the piston head 22 is located adjacent to the barrel-rear part 12. Leakage losses at the sealing surfaces have, or course, to be kept sufficiently low that it is possible for the volume of air acting as the air spring to apply sufficient force in order to guide the piston 21 back into its starting position.

Release of the bolt guide 3 enables it to be guided back by the helical spring 9 into its starting position, thereby pulling, via the connecting rod(s) 20, the barrel-rear part 12 and also the barrel-front part 11 forwards into the starting position of FIG. 1, with the result that the barrel-rear part 12 is again at a distance from the locking part 18, i.e. the bolt-setting tool is reset after the shot into the starting position without repeating.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. An explosive powder charge operated bolt-setting tool for setting a bolt and comprising:

a barrel guiding sleeve;

a locking part;

a piston including a piston shank and a piston head extending from the piston shank;

a barrel including a piston guiding bore, a mouth, and ventilation slots, said piston guiding bore including a cartridge store disposed remotely to said mouth, said barrel guided in the barrel guiding sleeve and configured for being brought into operative engagement with the locking part, the piston guiding bore accommodating the piston, the ventilation slots opening into the barrel, wherein the ventilation slots are blocked by the piston head when the piston is in a starting position and are configured to ventilate the barrel when said ventilation slots are released by the piston head as the bolt is being set, an air cushion excluding combustion gases being compressed between the piston head and the barrel when said bolt is being set, said air cushion subsequently pushing the piston to the starting position.

2. A tool according to claim 1, the piston head comprising a conical section proximate the piston shank and wherein the barrel includes a conical retainer accommodating the piston head conical section.

3. A tool according to claim 1, the barrel further comprising a barrel-front part and a barrel-rear part, one of which is placed in the other and can be moved axially with respect to the other.

4. A tool according to claim 3, wherein the barrel-front part and barrel-rear part respectively guide a section of the piston head, the ventilation slots being disposed adjacent the barrel-rear part.

5. A tool according to claim 4, the piston head including front and rear sections, said front and rear sections including diameters and wherein the piston head front section diameter is larger than the piston head rear section diameter.

6. A tool according to claim 1, further comprising a bolt guide disposed adjacent the mouth and through which the piston shank can travel, said bolt guide guided in the barrel-guiding sleeve and pretensioned with respect to the latter by means for spring-pretensioning, the bolt guide and the barrel being coupled in such a manner that they can be moved axially with respect to one another over a predetermined distance and, by releasing the spring-pretensioning means, the bolt guide pulls the barrel into a barrel starting position out of operative engagement with the locking part.

7. A tool according to claim 6, further comprising at least one connecting rod and wherein the bolt guide is coupled to the barrel via the at least one connecting rod.

8. A tool according to claim 1, further comprising a damping washer and wherein the damping washer is disposed adjacent the barrel mouth.

9. An explosive power charger operated bolt-setting tool comprising a barrel-guiding sleeve, a barrel slidingly retained in said sleeve, and a piston slidingly engaged in said barrel, the barrel having a first piston chamber including a combustion chamber, a second chamber connecting thereto and a piston shank receiving bore connecting to the second chamber, the piston including a piston head having a first section in the first piston chamber and a second section sealingly engaged in the second chamber, the piston further having a piston shank extending through the piston shank receiving bore, the barrel guiding sleeve having a bolt receiving bore, and ventilation slots which are released by the piston head as the bolt is being set and in which position an air cushion is compressed in the second chamber by the second section, said air cushion excluding combustion gases.

10. A tool according to claim 9, the piston further comprising a conical section disposed proximate an end of the piston shank and wherein the barrel includes a conical retainer accommodating the piston conical section.

11. A tool according to claim 9, the barrel further comprising a barrel-front part and a barrel-rear part, wherein one of said barrel front and rear parts is placed in the other and can be moved axially with respect to the other.

12. A tool according to claim 11, wherein the barrel-front part and barrel-rear part respectively guide a section of the piston head, the ventilation slots being arranged adjacent the barrel-rear part.

13. A tool according to claim 12, said first and second sections including diameters and wherein the piston head second section diameter is larger than the piston head first section diameter.

14. A tool according to claim 9, further comprising a bolt guide disposed adjacent the mouth and through which the piston shank can travel, said bolt guide guided in the barrel-guiding sleeve and pretensioned with respect to the latter by means for spring-pretensioning, the bolt guide and the barrel being coupled to one another in such a manner that they can be moved axially with respect to one another over a predetermined distance and, by releasing the spring-pretensioning means, the bolt guide pulls the barrel into its starting position out of operative engagement with the locking part.

15. A tool according to claim 14, further comprising at least one connecting rod and wherein the bolt guide is coupled to the barrel via the at least one connecting rod.

16. A tool according to claim 9, further comprising a damping washer and wherein the damping washer is disposed adjacent the barrel mouth.

* * * * *

UNITED STATES PATENT AND TRADEMARK OFFICE

CERTIFICATE OF CORRECTION

PATENT NO. : 6,123,242
DATED : September 26, 2000
INVENTOR(S) : Olaf Kersten

It is certified that error appears in the above-identified patent and that said Letters Patent is hereby corrected as shown below:

Column 1,
Line 9, "0233,740" should be -- 0,223,740 --.

Signed and Sealed this

Twenty-eighth Day of May, 2002

*Attest:*

*Attesting Officer*

JAMES E. ROGAN
*Director of the United States Patent and Trademark Office*